US005445120A

United States Patent [19]

Spence

[11] Patent Number: 5,445,120

[45] Date of Patent: Aug. 29, 1995

[54] DEVICE TO PREVENT AUTOMOBILE STARTER ENGAGEMENT WHEN ENGINE IS RUNNING

[76] Inventor: James Spence, 6 Lake Dr., Howell, N.J. 07731

[21] Appl. No.: 252,370

[22] Filed: Jun. 2, 1994

[51] Int. Cl.[6] ..... F02N 11/10

[52] U.S. Cl. ..... 123/179.3; 290/38 D; 200/82 DA

[58] Field of Search ..... 123/179.3, 179.4, 179.2; 290/38 D; 200/82 DA, 82 D, 82 R, 81 R; 307/10.6

[56] References Cited

U.S. PATENT DOCUMENTS

| | | | |
|---|---|---|---|
| 1,852,818 | 4/1932 | Miscera | 123/179.3 |
| 2,949,104 | 8/1960 | Davis | 123/179.3 |
| 2,949,105 | 8/1960 | Davis | 123/179.2 |
| 3,387,599 | 6/1968 | Cruse | 200/82 D |

FOREIGN PATENT DOCUMENTS

| | | | |
|---|---|---|---|
| 685783 | 7/1930 | France | 200/82 R |
| 697299 | 1/1931 | France | 200/82 D |
| 386704 | 1/1933 | United Kingdom | 290/38 D |

*Primary Examiner*—Andrew M. Dolinar
*Attorney, Agent, or Firm*—Ira M. Adler

[57] ABSTRACT

The invention relates to a device which prevents an automobile engine starter from engaging once an engine is running by using the running engine vacuum to cause the starter circuit to open.

1 Claim, 2 Drawing Sheets

DEVICE TO PREVENT AUTOMOBILE STARTER ENGAGEMENT WHEN ENGINE IS RUNNING

BACKGROUND - FIELD OF INVENTION

The invention relates to a device which prevents an automobile engine starter from engaging once an engine is running by using the running engine vacuum to cause the starter circuit to open. This prevents damage to the gears of a starter, which can be stripped if starting is attempted when the engine is running. The invention is particularly beneficial to the hearing impaired, whom due to their difficulty in hearing may not be aware that an automobile engine is running and may try to restart the engine. This could cause damage and endanger the automobile occupants.

BACKGROUND & DESCRIPTION OF PRIOR ART

In a prior invention, U.S. Pat. No. 2,437,023, a piston rod is moved in response to manifold vacuum, causing a break in the ignition circuit. Said circuit is controlled by a longitudinal break in the piston rod. In the present invention the circuit is directed across a flat valve. In the prior arrangement, the circuit often does not close due to contaminants in the gap, or may be subject to arcing and pitting. In the present invention, a filter is provided to avoid the possibility of contaminants and multiple points of contact avoid arcing. U.S. Pat. 2,261,232 uses a diaphragm and an indirect means to break the starter circuit. The current invention simplifies the objectives of avoiding unintended engine starter activation.

OBJECT & ADVANTAGES

The object of the invention is to provide a device which will prevent accidental restarting of an automobile engine starter once the engine is running.

DRAWING FIGURES

SPECIFICATION

Figure 1:
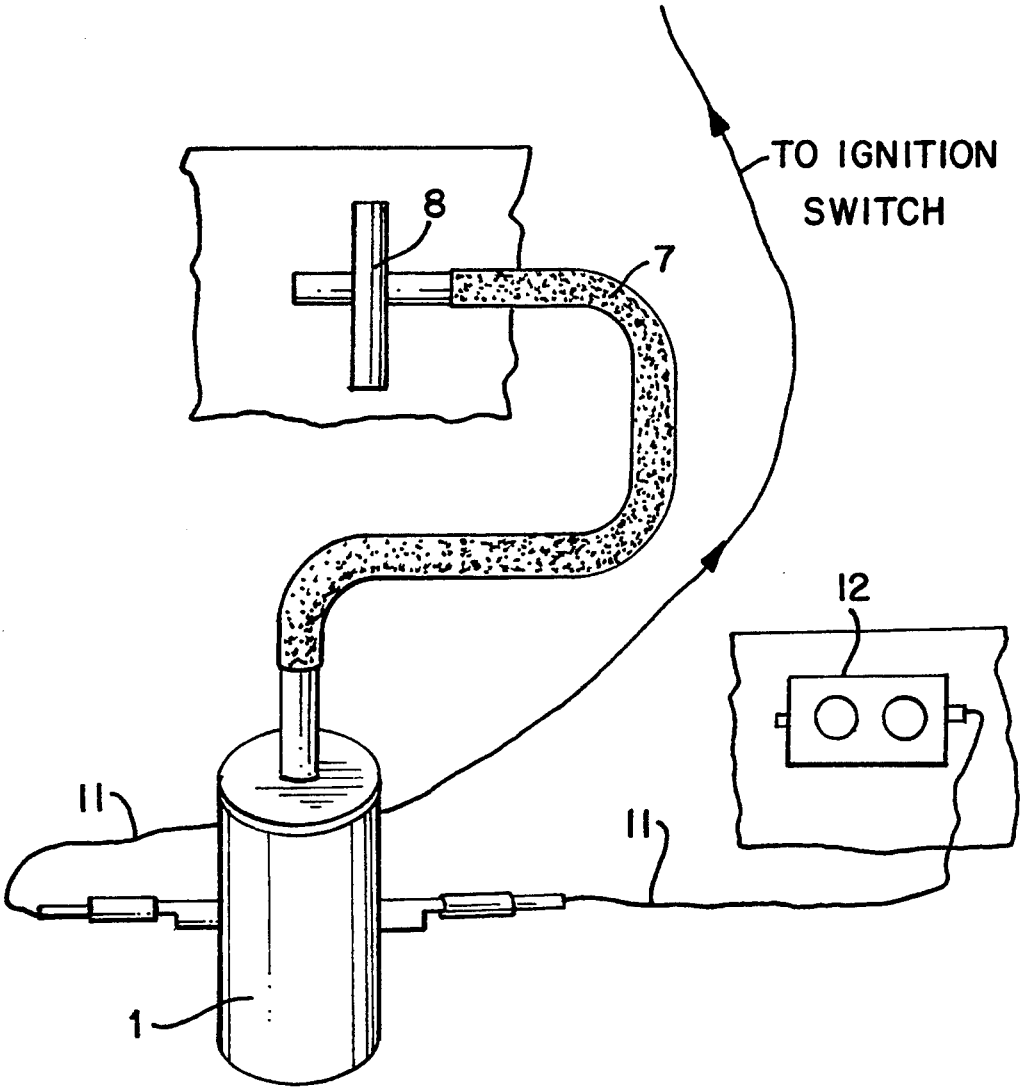
FIG. 1 is a perspective view of the invention attached to an engine intake manifold and automobile starting system.

Typically in the use of the invention, as shown in FIG. 1, a hollow cylindrical housing, 1, has one end of a hollow metal tube, 2, inserted into the outside top end of a bore which extends partially down the length of the housing. The housing may made of plastic or other non-conducting material. The other end of the hollow tube is attached to a flexible hose, 7, which, in turn is attached to a source of engine vacuum, such as the vacuum manifold, 8, which is often located on a vehicle's firewall. The engine vacuum is created as a by-product of a running internal combustion engine.

Figure 2:
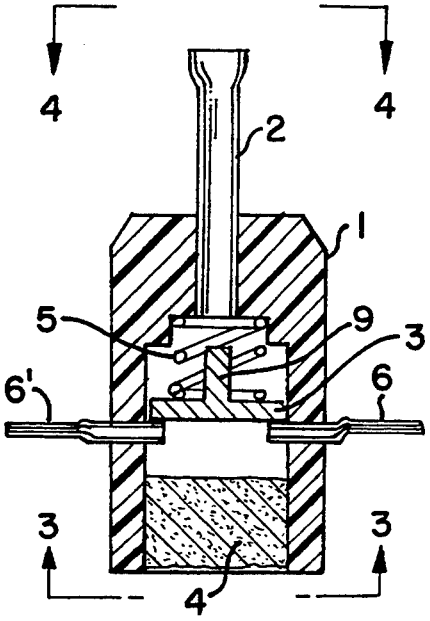
FIG. 2 is an section of the invention in the closed circuit position.

The bottom end of the housing, 1, is internally bored to about $\frac{2}{3}$ the length of the housing, with a hole larger than the upper hole, and up to the hole bored from the top end, as shown in FIG. 2. A spring, 5, is seated at the upper end of the hole. A thin round metal contact disc, 3, having a diameter slightly less than the bore of the bottom hole, is place against the bottom end of the spring. A round stem, 9, is affixed perpendicularly to the upper part of the metal contact disc at its center. The stem has a diameter slightly smaller than the inner diameter of the upper vacuum hole.

The spring, 5, is normally expanded and pushes the valve and attached stem towards the larger opening in the housing. A pair of pins, 6 and 6', are pressed into the side walls of the housing, at locations opposite each other. The pins extend into the inner bore of the housing, such that they prevent the valve from being ejected from the housing by the expansion of the spring.

Each pin, 6 and 6' is electrically connected by wires, 11, to the automobile's starting circuit. The starting circuit is completed when the metal valve is in contact with both pins, as in FIG. 2.

Figure 5:
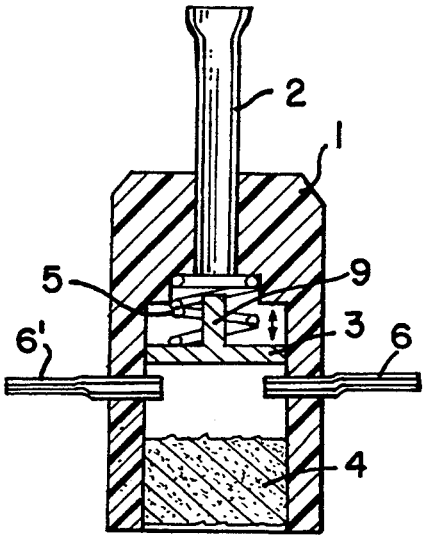
FIG. 5 is an section of the invention in the open circuit position.

When the engine is in operation, the vacuum at the vacuum source causes the metal valve to move towards the upper part of the housing, compressing the spring, and opening the electrical starter circuit, as in FIG. 5. When the engine is shut off, the spring pushes the valve against the pins and closes the starting circuit.

Figure 3:
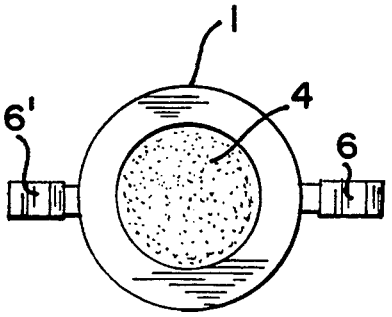
FIG. 3 is a bottom view of the invention.
Figure 4:
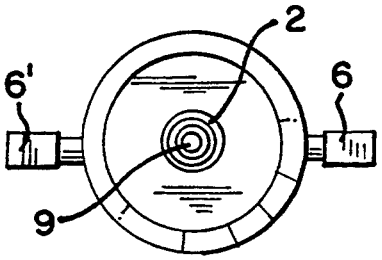
FIG. 4 is a top view of the invention.

To avoid contamination from being drawn into the running engine, through the bottom opening in the housing, a filter, 4, is inserted into the opening in the bottom end of the housing. The filter, 4, is seen in FIG. 3, a bottom view of the invention.

With the present invention in place, the starter circuit can not be accidentally activated while an engine is running.

What I claim is:

1. A device to prevent accidentally engagement of an automobile engine starter using engine vacuum comprising:

(a) A cylindrical non-conducting housing having an internal longitudinal bore at its top end and a larger internal longitudinal bore at its bottom end, such that both bores are connected;

(b) A suction tube inserted into the top end bore and extending outwardly therefrom;

(c) A flexible tube attached to the extended end of the suction tube;

(d) A round thin metal contact disc inserted into the bottom bore;

(e) A stem attached to the center of the metal contact disc and extending perpendicular towards the top bore;

(f) A normally extended spring inserted in the bottom bore between the top of the metal contact disc and the top end of the bottom bore, such that the spring is compressed when engine vacuum is applied through the suction tube and the flexible tube;

(g) An air filter inserted into the bottom end of the bottom bore;

(h) A pair of contact pins inserted into the opposite sides of the housing, extending into the bottom bore, such that the contact disc as pushed by the spring is kept from being ejected from the bore, and is in electrical contact with the inside ends of said pins and the outside ends of said pins are connected to a starter circuit.

* * * * *